United States Patent [19]

Coker

[11] 4,362,071

[45] Dec. 7, 1982

[54] CAN OPENER FOR TAB-TYPE CLOSURE

[76] Inventor: Jess M. Coker, 1803 E. Osborne Ave., Tampa, Fla. 33610

[21] Appl. No.: 236,140

[22] Filed: Feb. 20, 1981

[51] Int. Cl.[3] ..... B67B 7/40

[52] U.S. Cl. ..... 81/3.46 R; D8/18

[58] Field of Search ..... 81/3.46 R, 3.46 A, 3.34, 81/3.1 R; 220/274; D8/18, 33, 40

[56] References Cited

U.S. PATENT DOCUMENTS

| | | | |
|---|---|---|---|
| D. 240,497 | 7/1976 | Riba | D8/18 |
| D. 253,087 | 10/1979 | Schuller | D8/18 |
| 972,774 | 10/1910 | Murray | 81/3.46 R |
| 2,750,662 | 6/1956 | Kubik et al. | D8/18 |
| 3,459,075 | 8/1959 | Henderson | 81/3.34 |
| 3,460,411 | 8/1969 | Dyer | 81/334 |
| 3,724,297 | 4/1973 | Bucko | 81/3.46 A |
| 3,954,030 | 5/1976 | Newton | D8/18 |
| 4,207,781 | 6/1980 | Greenwood | 81/3.46 R |
| 4,241,626 | 12/1980 | Hall | 81/3.46 R |
| 4,287,794 | 9/1981 | Kubach et al. | 81/3.46 R |

*Primary Examiner*—Roscoe V. Parker

*Attorney, Agent, or Firm*—Frijouf, Rust & Pyle

[57] ABSTRACT

A can opener is disclosed for opening the types of closures commonly used on beer and soft drink cans. Those types of closures typically include a ring member operatively connected to the end of the can for engagement with a weakened portion of the end of the can. The can opener of the invention comprises a body portion, a head portion, and a handle. A lower lip member and an upper lip member are connected to the proximal end of the head portion. To open the closure of the can, the lower lip member is inserted under the ring member of the closure. The handle is grasped and the body portion is pivoted on the rim of the can to pull the ring member away from the can to completely remove the weakened portion of the closure from the can thereby producing an opening in the end of the can. A mouth portion is provided within the proximal end of the head portion for receiving the ring member during the opening procedure. The mouth portion enables the ring member to rotate therein to prevent the ring member from being accidentally disengaged from the weakened portion. The bottom of the body portion includes a substantially wide, inwardly concaved configuration which pivots on the rim of the can during opening. Such a configuration prevents the opener from tilting from side to side during the opening of the closure thereby preventing the ring member from being accidentally disengaged from the weakened portion.

1 Claim, 13 Drawing Figures

CAN OPENER FOR TAB-TYPE CLOSURE

BACKGROUND OF THE INVENTION

1. Field of the Invention

This invention relates to devices for opening containers such as cans. More particularly, this invention relates to openers designed to open pull-type closures such as those commonly found on beer and soft drink cans.

2. Description of the Prior Art

Presently there exists an almost infinite number of different types of closures. In the soft drink and beer can industry, however, there exists only a few types of closures which have been widely accepted. The first type of such closures comprise a ring member or tab which is secured to a weakened portion of the end of the can. The closure is opened by first pulling upward on the ring member to initiate the tearing of the weakened portion from the can. This is what is commonly referred to as "popping" the can. The ring member is then pulled in a direction over the weakened portion to entirely rip the weakened portion from the can. An opening is thus produced in the end of the can.

The second most common type of closure used in the soft drink and beer can industry comprises a ring member which is pivotally connected to the end of the can. The base of the ring member is positioned over a weakened portion of the can. By pivoting the ring member, the base is forced against the weakened portion to cause the weakened portion to be torn from the end of the can and pushed inwardly into the can. The ring member is then returned to its nonactuated position.

The third type of closure comprises a large and a small weakened portion disposed on the end of the can. The consumer opens the closure of the can by pushing inwardly on each of the weakened portions. The smaller weakened portion serves as a vent whereas the larger weakened portion serves as an opening from which the consumer may pour or drink the contents of the can. Because of the difficulty in pushing the weakened portions in the can, this third type of closure has not been as widely used as the first and second types as previously described. U.S. Pat. Nos. Des. 240,497, Des. 253,087, 2,750,662, and 3,954,030 teach a variety of can openers designed to enable the consumer to quickly and easily open this third type of closure.

Accordingly, it can be said that the first and second types of closures discussed above are found on the great majority of all of the soft drink and beer can containers. U.S. Pat. No. Des. 253,087, issued to Schuller, teaches a can opener having an end portion which could conceivably be used to open such a first and second type of closures. Specifically, the patent to Schuller teaches a can opener having a V-shaped end portion which could be used to grasp the ring member of such closures. The can opener could then be pivoted to "pop" the ring tab and open the closure by pulling the ring member and the weakened portion from the can. Experience has shown, however, that the can opener taught by Schuller is difficult to use. Specifically, the Schuller can opener has a tendency to tilt from side to side and if pressure is applied until the tab is forced to separate from the can, then the tab will be projected by sudden release of tensed forces with possible injury to bystanders. The prior art device can be used safely only to break the seal, whereafter the loosened tab is removed by finger grip of the consumer. Sometimes the tab will rupture, leaving a ragged remainer still attached to the can. The consumer is then faced with the difficult problem of attempting to remove the weakened portion with a pair of pliers or similar tool. Needless to say, the Schuller can opener has not become widely accepted by most consumers.

Accordingly, it is an object of this invention to provide an apparatus which overcomes the aforementioned inadequacies of the prior art devices and provides an improvement which is a significant contribution to the advancement of the can opener art.

Another object of this invention is to provide a can opener which enables a consumer to quickly and easily open a closure of a soft drink or beer can container.

Another object of this invention is to provide a can opener having a wide bottom portion which prevents the can opener from tilting from side to side as the can opener opens the closure of the can.

Another object of this invention is to provide a can opener having a tread secured to the bottom of the can opener to prevent slippage between the cap opener and the rim of the can during opening of the closure.

Another object of this invention is to provide a can opener having a handle connected thereto which enables a consumer to comfortably grasp and operate the can opener to open the closure of the can.

Another object of this invention is to provide a can opener having a clip retaining means which retains the ring member of the closure within a mouth portion of the can opener after the closure is opened.

Another object of this invention is to provide a can opener having a mouth portion which comprises a substantially semi-circular cross-section which enables the ring member to pivot therein thereby preventing the ring member from being torn from the weakened portion during the opening of the closure.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims to cover the disclosed embodiments shown in the attached drawings and the equivalent thereof as set forth in the detailed discussion. For the purpose of summarizing the invention, this invention comprises an opener for opening a closure of a container. More specifically, this invention comprises a can opener for opening the types of closures commonly used on beer and soft drink can containers. Those types of closures typically include a ring member operatively connected to the end of the can for engagement with a weakened portion of the end of the can. In the first type of closure, the ring member is connected to the weakened portion of the end of the can such that upon pulling the ring member away from the can, the weakened portion is torn from the end of the can thereby creating an opening therein. In the second type of closure, the ring member, when pivoted, bears against the weakened portion to force the weakened portion into the can itself, thereby creating an opening therein. It should be understood that the opener of the subject invention may be used to open both types of closures. For the sake of brevity, the discussion which follows shall be limited to the first type of closure discussed above.

The opener of the subject invention comprises a body portion, a head portion, and a handle. A lower lip member and an upper lip member are connected to the proximal end of the head portion. To open the closure of the can, the lower lip member is inserted under the ring member of the closure. The handle is grasped and pivoted downwardly to "pop" the ring member thereby initiating the opening of the weakened portion of the closure. Further downward movement of the handle causes the ring member to completely rip the weakened portion from the can. An opening is therefore formed within the can.

A feature of the opener of this invention is the configuration of the body portion. Specifically, the body portion comprises outwardly sloping sides to define a wide bottom thereof. The wide bottom of the body portion provides a sturdy support for the opener thereby preventing the opener from tilting from side to side. The ring member is therefore prevented from being torn loose from the weakened portion during the opening of the closure. It is noted that the bottom of the body portion may be concaved inwardly to prevent the body portion from riding against the rim of the can during the pivoting motion.

A tread is connected to the underside of the bottom of the body portion to prevent slippage of the body portion on the rim of the can during the opening of the closure. In one embodiment, the tread comprises grooves which extend transversely across the bottom of the body portion. The rim of the can is seated within one of the grooves to prevent any slippage of the body portion on the rim of the can. In another embodiment, the tread comprises two lengths of resilient tubing, each of which is cut longitudinally to be secured over the edge formed by the bottom and the sides of the body portion. Such lengths of tubing operate in substantially the same manner as the previously described embodiment of the treads.

Another feature of the opener of this invention is the mouth portion located between the lower and upper lip members. Specifically, the mouth portion is configured to receive the ring member during the opening of the closure. Such a configuration enables the ring member to rotate within the mouth portion thereby preventing the ring member from being torn away from the weakened portion of the closure.

A retaining clip means is incorporated within the head portion of the opener. The retaining clip means retains the ring member within the mouth portion of the opener. The ring member is therefore prevented from being accidentally discharged from the mouth portion. Actuation of the retaining clip means enables the ring member to be discharged from the mouth portion by inverting the opener.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
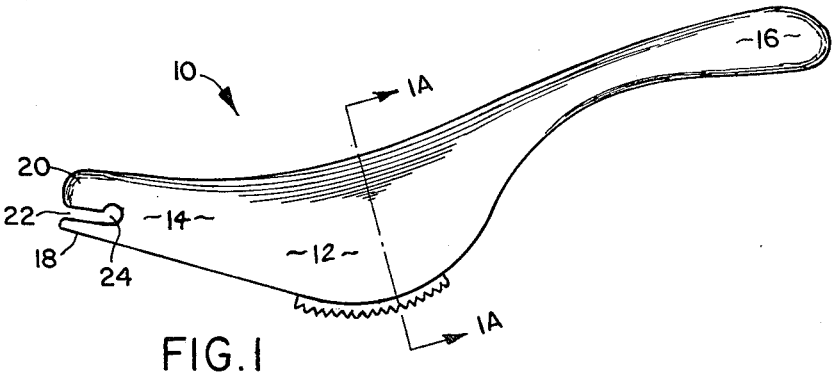
FIG. 1 is a side view of the invention.

FIG. 1 is a side view of the opener 10 of the invention. Basically, the opener 10 comprises body portion 12, head portion 14, and handle 16. A lower lip member 18 is connected to the distal end of the head portion 14. An upper lip member 20 is similarly connected to the distal end of the head portion 14 in juxtaposition with the lower lip member 18 thereby defining a gap 22 therebetween. A mouth portion 24 is located rearwardly from the gap 22.

FIGS. 4–7 illustrate the manner in which the opener 10 is used to open a container such as a can 26. More particularly, can 26 includes an end portion 28 having a closure 30 molded therein. Closure 30 may comprise a ring member 32 which is secured to a weakened portion 34 of the closure 30. During opening, the lower lip member 18 is inserted under the ring member 32 such that the bottom 44 of the body portion 12 rests on the rim 36 of the can 26. The handle 16 of the opener 10 is pivoted downwardly as shown by arrow 38 to the position shown in FIGS. 6 and 7 thereby causing the ring member 32 to initiate the tearing of the weakened portion 34 from the end portion 28 of the can 26. Further downward movement of the handle 16 as shown by arrow 40 causes the weakened portion 34 to be entirely ripped from the can 26. An opening is therefore formed within the end portion 28 of the can 26. Immediately after such opening, the ring member 32 together with the weakened portion 34 remains within the mouth portion 24 of the opener 10. The ring member 32 is discharged from the mouth portion 24 by inverting the opener 10.

It is readily apparent that the opener 10 of the subject invention enables a consumer to quickly and easily open a can 26 having a pull-ring type closure 30. Such closures 30 are generally of two types. The most prevalent type available on the market today is that which was disclosed above. Another type of pull-ring closure 30 comprises a ring member 32 which is pivotally connected to the end portion 28 of a can 26. Upon pivoting, the ring member 32 exerts pressure against a weakened portion of the can 26 thereby causing the weakened portion to be pressed inwardly into the can 26. It should be understood that the opener 10 of the subject invention is able to open both of the general types of pull-ring closures 30. For the sake of brevity, the discussion above and that which follows is directed toward the pull-ring closure 30 in which the weakened portion 34 is completely removed from the can 26.

Returning to FIG. 1, it is noted that the handle 16 extends from the body portion 12 at an angle obtuse to the head portion 14. Such a displacement of the handle 16 with respect to the head portion 14 enables a consumer to comfortably grasp the handle 16 of the opener 10 to open the closure 30 of the can 26. Moreover, such displacement of the handle 16 enables the consumer to completely open the closure 30 without having to reposition his grip on the handle 16.

Figure 6A:
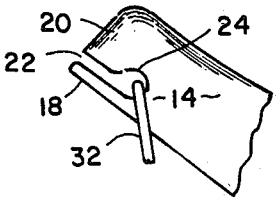
FIG. 6A is an enlarged view showing the ring member of the closure within the mouth portion of the invention.

The mouth portion 24 of the opener 10 is designed to enable the ring member 32 to pivot therein. Specifically, as shown in FIG. 6A, the mouth portion 24 has a substantially semi-circular cross-section which provides room for the ring member 32 to rotate therein as the ring member 32 and the weakened portion 34 are disconnected from the can 26 during opening. The ring member 32 is therefore prevented from being torn from the weakened portion 34 during opening.

Figure 3:
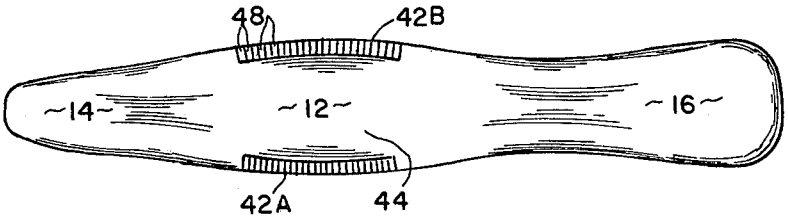
FIG. 3 is a bottom view of the invention showing the first embodiment of the tread means.
Figure 2:
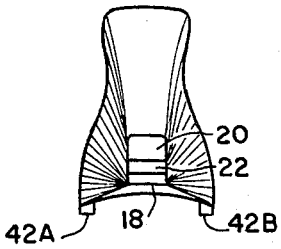
FIG. 2 is a front view of the invention.
Figure 10:
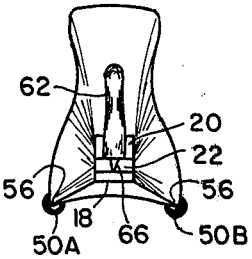
FIG. 10 is a front view of FIG. 9.
Figure 8:
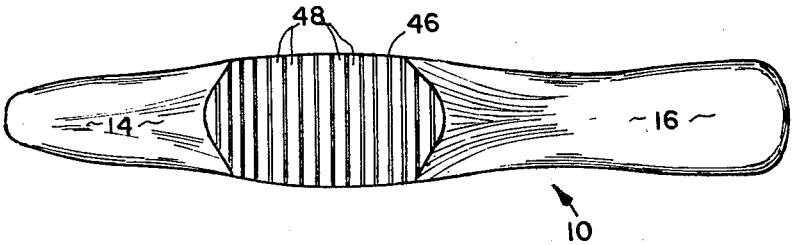
FIG. 8 is a bottom view of the second embodiment of the tread means.
Figure 9:
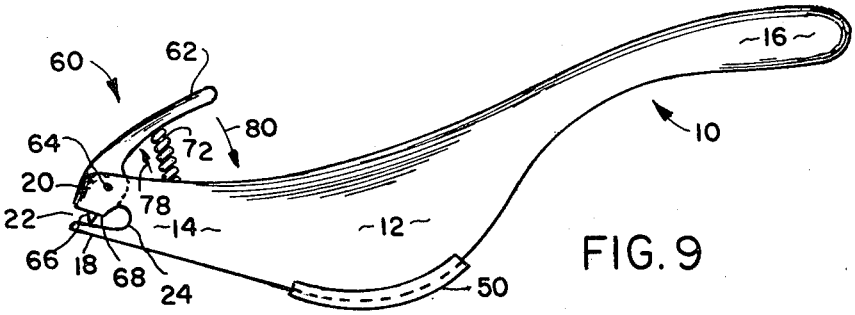
FIG. 9 is a side view of the invention showing the retaining clip means incorporated therein.

Experience has shown that the body portion 12 of the opener 10 may have a tendency to slip when being pivoted over the rim 36 of the can 26. In order to prevent such slippage, a tread 42 is secured to the bottom 44 of the body portion 12. The first embodiment of the tread 42 is illustrated in FIGS. 1–3, and comprises individual treads 42A and 42B connected on opposed sides of the bottom 44 of the body portion 12. As shown in FIG. 8, the second embodiment of the tread 42 comprises a sheet of tread material 46 which is secured to the bottom 44 of the body portion 12. In both the first and second embodiments, the treads 42 and 46 comprise grooves 48 which extend transversely across the bottom 44 of the body portion 12. The rim 36 of the can 26 is therefore able to be seated within one of the grooves 48 to prevent any slippage of the body portion 12 on the rim 36 of the can 26 during the pivoting of the body portion 12. Finally, the third embodiment of the tread 42 is illustrated in FIGS. 9 and 10 and comprises two lengths of tubing 50, each of which is cut longitudinally to be secured over the edge 56 formed by the bottom 44 and the sides 54 of the body portion 12 by adhesive. Preferably, the cylindrical members 50A and 50B comprise a resilient material which is easily deformed during the pivoting action of the body portion 12 on the rim 36 of the can to prevent slippage therebetween.

Figure 1A:
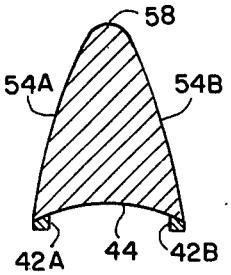
FIG. 1A is a cross-sectional view of FIG. 1 along lines 1A—1A.

FIG. 1A is a cross-sectional view of FIG. 1 along lines 1A—1A to illustrate the cross-sectional configuration of the body portion 12 of the opener 10. Specifically, the body portion 12 comprises a smooth, rounded top portion 58, outwardly sloping sides 54A and 54B, and an inwardly concaved bottom 44. The rounded top 58 and the sloped sides 54A and 54B provide a comfortable grip for the thumb and the index finger of the hand of the person using the opener 10. The bottom 44 is relatively wide which prevents the bottom 44 from tilting from side to side during the opening of the closure 30. The bottom 44 may be concaved inwardly to assure that the center of the bottom 44 will not engage the rim 36 of the can 26 during pivoting.

Figure 9A:
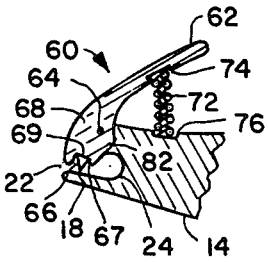
FIG. 9A is a partial cross-sectional view of FIG. 9 showing the retaining clip means in more detail.

The opener 10 of the invention as previously described may be improved by incorporating a retaining clip means 60 which prevents the ring member 32 from being accidentally discharged from the mouth portion 24. As shown in FIGS. 9, 9A, and 10, the retaining clip means 60 comprises an actuating lever 62 pivotally connected to the upper lip member 20 by means of a pivot pin 64. A tooth member 66 secured within an enlarged aperture 67 by means of adhesive 69 extends from the proximal end 68 of the actuating lever 62. A compression spring means 72 is positioned between the actuating lever 62 and the head portion 14. Apertures 74 and 76 located within the actuating lever 62 and the head portion 14 secures the spring means 72 into its position. The spring means 72 urges the actuating lever upwardly as shown by arrow 78 to force the tooth member 66 across the gap 22 between the lower lip member 18 and the upper lip member 20. After opening the closure 30 of the can 26, the ring member 32 is retained within the mouth portion 24 by means of the retaining clip means 60. The ring member 36 is therefore prevented from being accidentally discharged from the mouth portion 24 and dropped on the floor. Actuation of lever 62 discharges the ring member 32 from the mouth portion 24 as the opener 10 is inverted.

Figure 4:
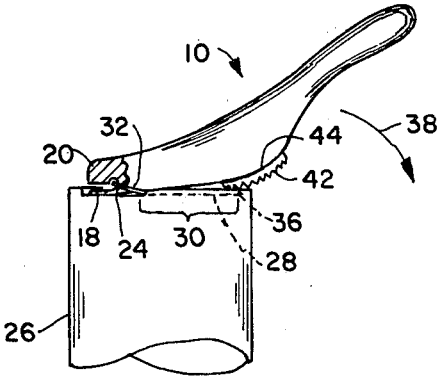
FIG. 4 is a side view of the invention in position to initiate the opening of the closure of a can.
Figure 6:
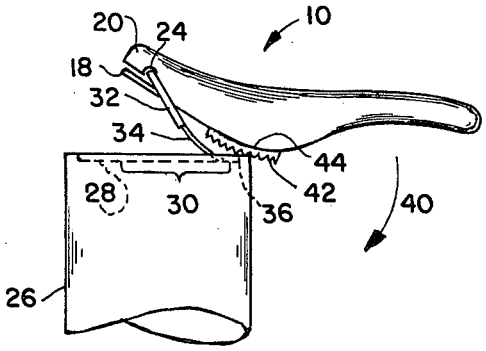
FIG. 6 is a side view of the invention opening the closure of the can.
Figure 5:
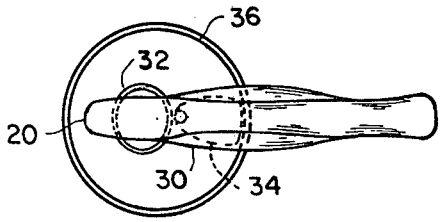
FIG. 5 is a plan view of FIG. 4.
Figure 7:
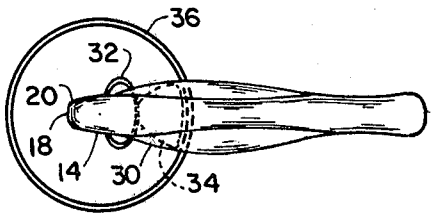
FIG. 7 is a plan view of FIG. 6.

Preferably, tooth member 66 comprises a resilient, semi-rigid material having sufficient resiliency to enable the ring member 32 to be inserted within the mouth portion 24 when the opener is positioned as shown in FIG. 4. After opening of the closure 30, the ring member 32 may be ejected from the mouth portion 24 by inverting the opener 10 and actuating the lever 62 as shown by arrow 80. It is noted that a stop 82 may be incorporated at the proximal end 68 of the lever 62 to prevent the tooth member 62 from being deformed against the lower lip member 18 by the pressure exerted by the spring means 72.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. An opener for opening a closure of a container, the closure including a ring member for engagement with a weakened portion of the container, the opener comprising in combination:

a body portion having a wide bottom for pivoting on the container during the opening of the closure;

said bottom of said body portion being concaved inwardly to define two longitudinal legs for pivoting on the container;

a head portion secured to said body portion;

a lower lip secured to said head portion for insertion under the ring member of the closure;

a mouth portion for receiving the ring member after said lower lip is inserted thereunder;

a handle secured to said body portion enabling a person to grasp the opener, insert the lower lip under the ring member, and pivot said body member on the container to pull the ring member away from the container thereby causing the ring member to engage the weakened portion of the container to create an opening therein.

* * * * *